US009169847B2

(12) United States Patent
Krehbiel et al.

(10) Patent No.: US 9,169,847 B2
(45) Date of Patent: Oct. 27, 2015

(54) AUXILIARY BEARING LANDING GUARD

(75) Inventors: William Courtney Krehbiel, San Marcos, CA (US); Jess Lee Freeman, Poway, CA (US); Steven Gene Muse, Poway, CA (US)

(73) Assignee: Solar Turbines Incorporated, San Diego, CA (US)

( * ) Notice: Subject to any disclaimer, the term of this patent is extended or adjusted under 35 U.S.C. 154(b) by 653 days.

(21) Appl. No.: 13/550,327

(22) Filed: Jul. 16, 2012

(65) Prior Publication Data

US 2014/0017078 A1 Jan. 16, 2014

(51) Int. Cl.

| | |
|---|---|
| ***F04D 29/05*** | (2006.01) |
| ***F04D 29/056*** | (2006.01) |
| ***F04D 29/058*** | (2006.01) |
| ***F04D 29/059*** | (2006.01) |

(52) U.S. Cl.

CPC ..... *F04D 29/058* (2013.01); *F04D 29/059* (2013.01)

(58) Field of Classification Search

CPC ..... F04D 29/05; F04D 29/056; F04D 29/058; F04D 29/059

See application file for complete search history.

(56) References Cited

U.S. PATENT DOCUMENTS

| | | | | |
|---|---|---|---|---|
| 4,982,126 | A * | 1/1991 | Jolivet et al. | 310/90 |
| 5,714,818 | A * | 2/1998 | Eakman et al. | 310/90.5 |
| 5,739,609 | A | 4/1998 | Ueyama et al. | |
| 5,747,907 | A * | 5/1998 | Miller | 310/90 |
| 7,217,039 | B2 * | 5/2007 | Baudelocque et al. | 384/624 |
| 7,952,247 | B2 | 5/2011 | Menz et al. | |
| 2008/0218008 | A1 | 9/2008 | Ghasripoor et al. | |
| 2008/0219834 | A1 | 9/2008 | Merfeld et al. | |

FOREIGN PATENT DOCUMENTS

| | | | |
|---|---|---|---|
| EP | 2448088 | A2 | 5/2012 |

OTHER PUBLICATIONS

Sears et al. "Magnetic Bearing Operating Experience." Proceedings of the Twenty-Third Turbomachinery Symposium. 1994. pp. 235-242.

Tessier. "The Development of an Auxiliary Bearing Landing System for a Flexible AMB-Supported Hydrogen Process Compressor Rotor." Proceedings of Mag '97, Industrial Conference and Exhibition on Magnetic Bearings. Aug. 21-22, 1997. pp. 120-128.

Barbey et al. "SKF Response to Solar AMB Patent Applications." Jul. 29, 2014, 8 pages.

Schweitzer et al. "Magnetic Bearings: Theory, Design, and Application to Rotating Machinery." 2009. Section 13.5: Design Considerations (pp. 401-404).

* cited by examiner

*Primary Examiner* — Igor Kershteyn

(74) *Attorney, Agent, or Firm* — Procopio, Cory, Hargreaves & Savitch LLP

(57) ABSTRACT

Radial magnetic bearings (125) of a centrifugal gas compressor (100) may lose power and fail to support the shaft (120) resulting in damage to the shaft (120). Auxiliary bearings (135) may be used to support the shaft (120) during such a failure. A landing guard (140) may be installed as a sacrificial piece between the shaft (120) and the auxiliary bearings (135). Landing guard (140) includes slots (144) that may be used with pins (121) in the shaft (120) to prevent an angular displacement between the landing guard (140) and the shaft (120).

19 Claims, 3 Drawing Sheets

AUXILIARY BEARING LANDING GUARD

TECHNICAL FIELD

The present disclosure generally pertains to centrifugal gas compressors, and is more particularly directed toward an auxiliary bearing landing guard of a centrifugal gas compressor magnetic bearing.

BACKGROUND

The use of magnetic bearings in rotary machines such as centrifugal gas compressors is increasing. Magnetic bearings work on the principle of electromagnetic suspension. The use of electromagnetic suspension reduces or eliminates friction losses in centrifugal gas compressors.

Magnetic bearings in rotary machines are generally arranged with multiple windings or electric coils surrounding a shaft formed from a ferromagnetic material. Some magnetic bearings use a ferromagnetic lamination on the shaft when the shaft is not formed from a ferromagnetic material. The windings in a radial magnetic bearing radially surround the shaft and produce a magnetic field that tends to attract the rotor shaft. The attractive forces of the windings may be controlled by varying the current in each winding.

E.P. Patent Ser. No. 2,448,088, to K. Weeber discloses a rotor shaft assembly that includes a rotor landing sleeve shrunk-fit onto each end of the rotor shaft. The landing sleeve engages an inner race of a roller-element backup bearing in the event of a rotor landing.

The present disclosure is directed toward overcoming one or more of the problems discovered by the inventors.

SUMMARY OF THE DISCLOSURE

An auxiliary bearing landing guard for a shaft of a centrifugal gas compressor with a radial magnetic bearing includes a landing portion with an axially elongated tubular shape and an exterior landing surface. The landing surface configured to contact the auxiliary bearing when the radial magnetic bearing fails. The landing guard also includes an inner surface is located radially inward from the landing surface. The inner surface is configured to contact the auxiliary bearing when the radial magnetic bearing fails. The landing guard also includes a slot located on the inner surface extending axially from an aft end of the landing guard toward a forward end of the landing guard. The slot is configured to prevent angular displacement between the shaft and the landing guard when the landing guard is installed on the shaft. The landing guard further includes an annular flange extending from an aft end of the landing portion with an outer diameter located radially outward from an outer diameter of the landing portion.

DETAILED DESCRIPTION

Figure 1:
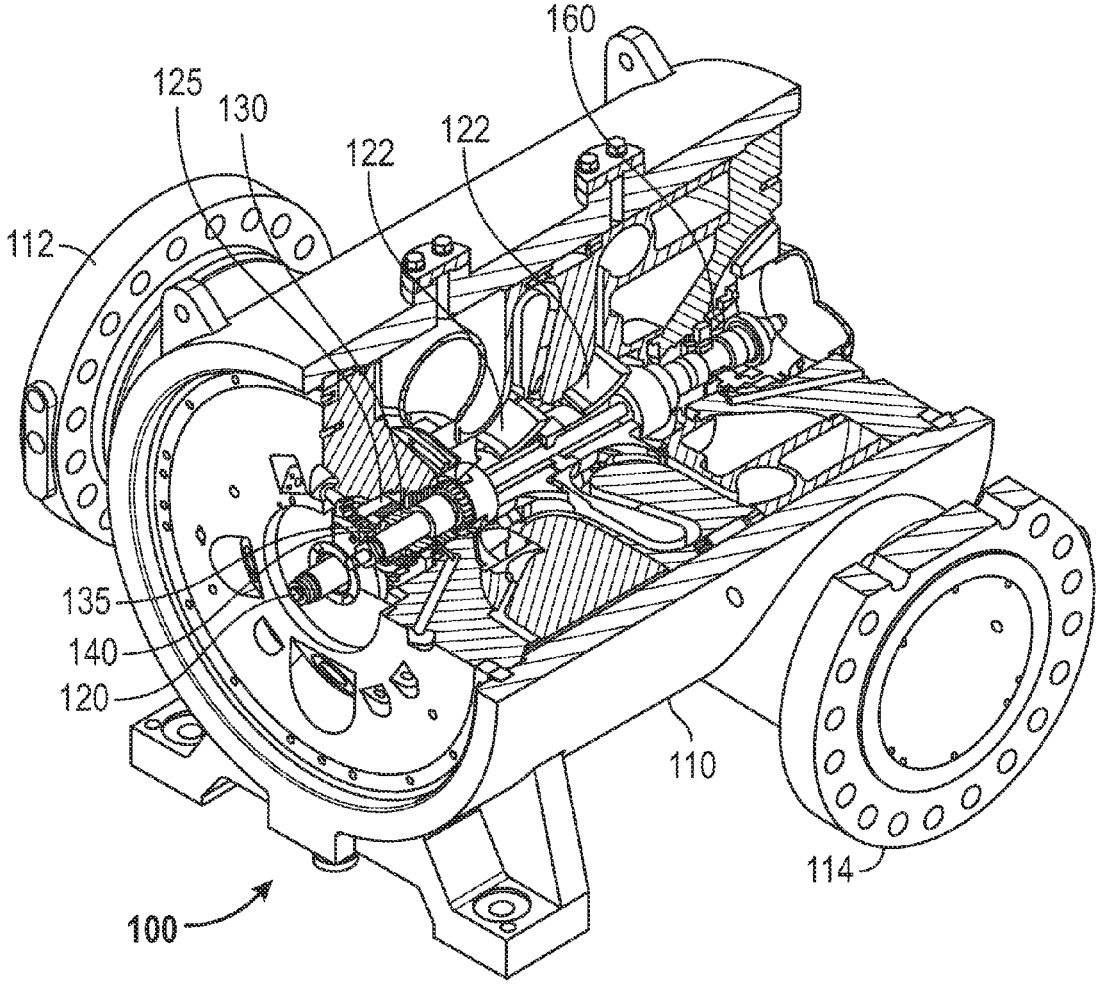
FIG. 1 is a cutaway illustration of an exemplary centrifugal gas compressor.

FIG. 1 is a cutaway illustration of an exemplary centrifugal gas compressor 100. Process gas enters the centrifugal gas compressor 100 at a suction port 112 formed on a housing 110. The process gas is compressed by one or more centrifugal impellers 122 mounted to a shaft 120. The compressed process gas exits the centrifugal gas compressor 100 at a discharge port 114 that is formed on the housing 110. For convention in this disclosure, the suction end of the centrifugal gas compressor 100 is considered the forward end and the discharge end is considered the aft end. All references to radial, axial, and circumferential directions and measures refer to the axis of shaft 120, unless specified otherwise.

Shaft 120 and attached elements may be supported by bearings such as a radial magnetic bearing 125 and an aft radial bearing 160 installed on axial ends of the shaft 120. A radial magnetic bearing lamination sleeve 130 may be installed onto shaft 120 as part of the radial magnetic bearing 125.

Auxiliary bearings 135 may be installed with the radial magnetic bearing 125. Auxiliary bearings 135 may be angular contact bearings. Landing guard 140 may be installed onto shaft 120 with a thermal interference fit and may be installed between shaft 120 and auxiliary bearings 135.

Figure 2:
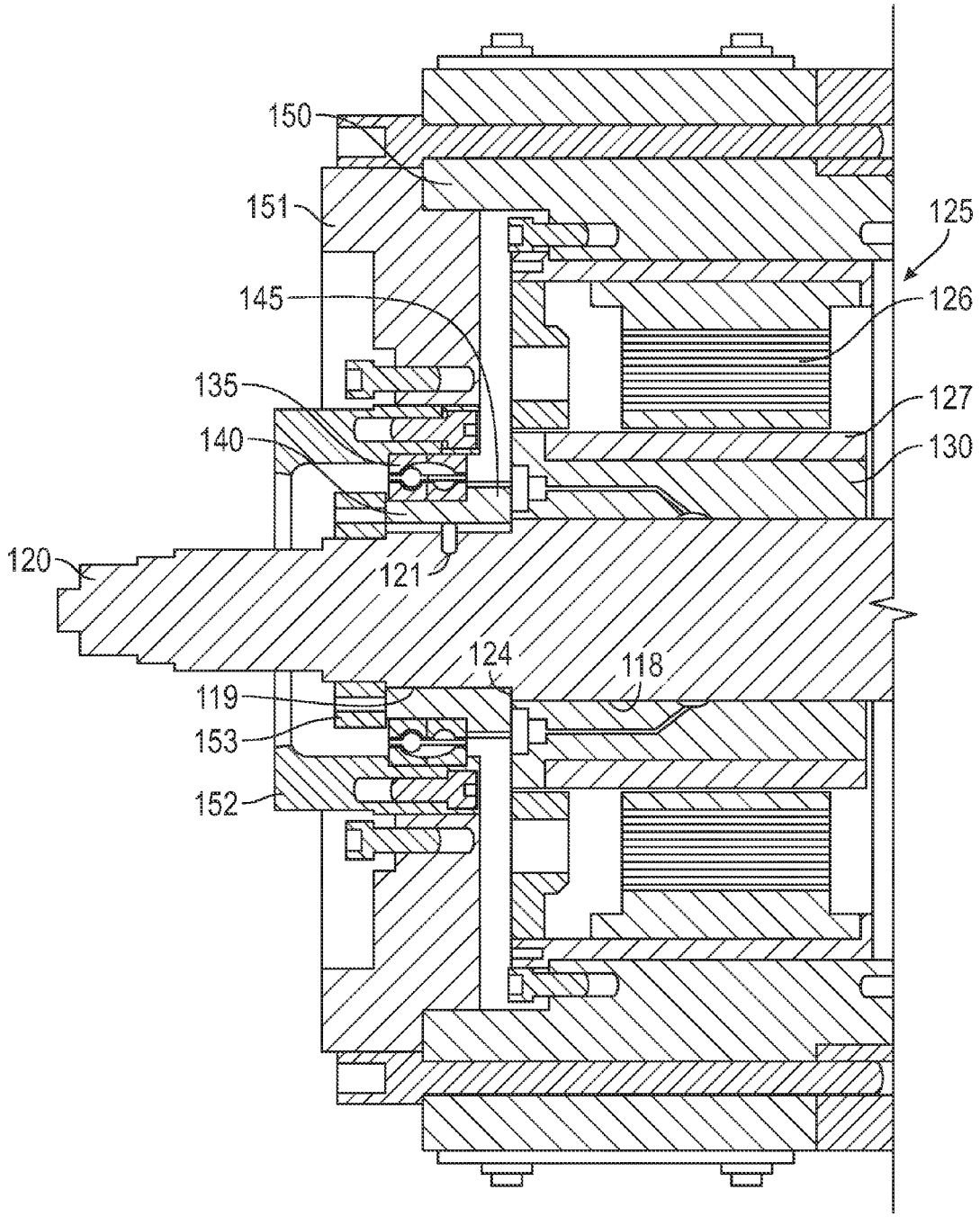
FIG. 2 is a partial cross-sectional view of a suction end of a centrifugal gas compressor including a radial magnetic bearing.

FIG. 2 is a partial cross-sectional view of the suction end of the centrifugal gas compressor 100. In particular, the suction end of the centrifugal gas compressor 100 schematically illustrated in FIG. 1 is shown here in greater detail, including radial magnetic bearing 125. Radial magnetic bearing 125 is located near the forward end of shaft 120 axially aft of auxiliary bearing 135.

Shaft 120 may include a first region generally indicated as 118 and a second region generally indicated as 119. A shelf 124 forms the transition between these two regions, and extends radially outward from region 119 to region 118 in a direction orthogonal to the surfaces of the regions. In one embodiment region 118 is tapered where the outer diameter of the aft end of region 118 is larger than the outer diameter of the forward end of region 118. The outer diameter of region 119 is smaller than the outer diameter of the forward end of region 118. Region 119 is located axially forward of region 118. The varying diameters of shaft 120 may facilitate the installation of radial magnetic bearing 125.

Radial magnetic bearing 125 includes lamination sleeve 130. Lamination sleeve 130 may be installed onto shaft 120 with an interference fit. The inner surface of lamination sleeve 130 contacts region 118 of shaft 120. Lamination sleeve 130 may include a flange extending radially outward at the forward end. Generally lamination sleeve 130 will not include ferromagnetic materials.

Lamination 127 is located radially outward from lamination sleeve 130. Lamination 127 is attached or coupled to lamination sleeve 130 at the outer surface of lamination sleeve 130 adjacent to the flange on lamination sleeve 130. The height or thickness of the flange on lamination sleeve 130 may correspond to the height or thickness of lamination sleeve 130. Lamination 127 includes ferromagnetic materials.

Windings 126 are located radially outward from lamination 127 with a radial gap between windings 126 and lamination 127. Windings 126 are aligned axially with lamination 127. Windings 126 may be circumscribed by endcap 150.

Landing guard 140 may be installed onto shaft 120 with an interference fit. All references to radial, axial, and circumferential directions and measures for elements of landing guard 140 refer to the axis of landing guard 140, which is concentric to the axis of shaft 120. The inner surface 143 (shown in FIG. 3) of landing guard 140 contacts region 119 of shaft 120. The aft end of landing guard 140 abuts shelf 124 and the forward end of lamination sleeve 130. Landing guard 140 may include flange 145 at the aft end which increases the height or thickness of the aft end of the landing guard 140.

One or more pins 121 may be installed into shaft 120 within region 119 of shaft 120. Pins 121 may be cylindrically shaped with rounded ends. Pins 121 may interface with slots 144 (shown in FIG. 3) of landing guard 140 when landing guard 140 is installed to shaft 120.

Auxiliary bearings 135 are located radially outward from landing guard 140 with a radial gap between auxiliary bearings 135 and landing guard 140. The radial gap between auxiliary bearings 135 and landing guard 140 may be smaller than the radial gap between windings 126 and lamination 127. Auxiliary bearings 135 may be adjacent to flange 145 with an axial gap between auxiliary bearings 135 and flange 145.

Endcaps 151, 152, and 153 may be installed at the forward end of the centrifugal gas compressor 100. Endcap 153 is located forward of landing guard 140 and radially outward from shaft 120. Endcap 152 axially overlaps with landing guard 140 and is located radially outward from endcap 153 and landing guard 140. Endcap 151 is located forward of windings 126 and radially outward from endcap 152.

Figure 3:
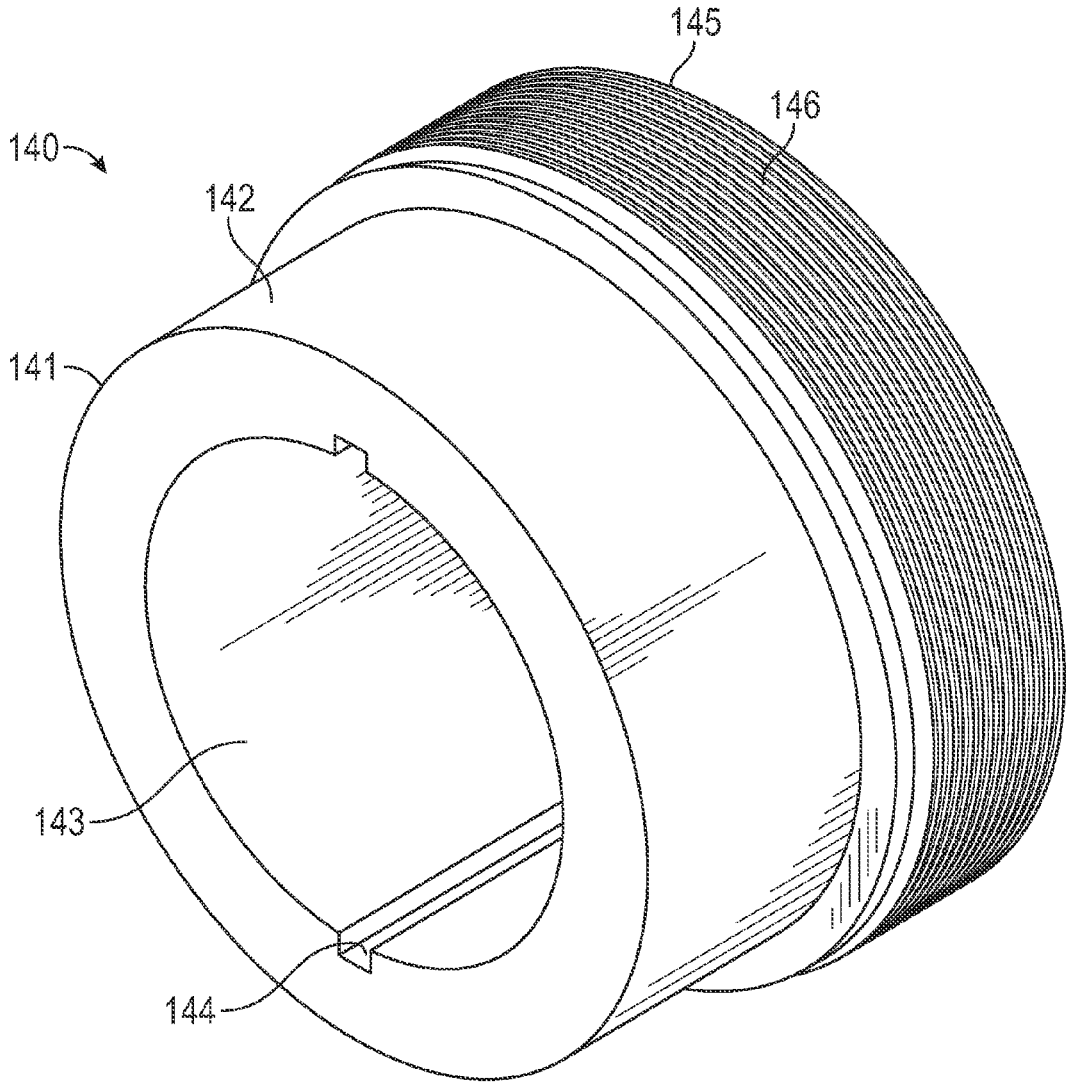
FIG. 3 is an isometric view of an exemplary landing guard of an auxiliary bearing.

FIG. 3 is an isometric view of the landing guard 140 shown in FIG. 2. Landing guard 140 is configured to extend axially within the centrifugal gas compressor and includes landing portion 141. Landing portion 141 generally has a tubular shape. The tubular shape being a thickened and elongated circular shape such as a hollow cylinder. Inner surface 143 is the cylindrical surface that defines the radially inner boundary of landing guard 140 including landing portion 141. Landing surface 142 is a cylindrical surface located radially outward from inner surface 143. Landing surface 142 may define all or a forward segment of the radially outer boundary of landing guard 140 including landing portion 141. Landing surface 142 and inner surface 143 generally define the tubular shape of landing portion 141. A coating, such as a nitride coating, may be applied to landing surface 142.

Slot 144 is an axial channel extending along inner surface 143 and may extend from the aft end of landing guard 140. Slot 144 extends far enough forward from the aft end of landing guard 140 along inner surface 143 for landing guard 140 to receive a pin 121 when landing guard 140 is installed onto shaft 120. The cross-section of slot 144 may be square, round, arced, oval, or any other shape that may be configured to receive pin 121. Landing guard 140 may include multiple slots 144. In one embodiment each slot 144 extends from the forward end of landing guard 140 to the aft end of landing guard 140.

Landing guard 140 may also include flange 145 located at the aft end of landing guard 140. Flange 145 extends radially outward beyond landing surface 142 and is located axially aft of landing surface 142. The cross-section of landing guard 140 with flange 145 is generally an L-shape. Flange 145 may include threads 146. Threads 146 are located on the radially outer surface of flange 145.

The materials used to manufacture landing guard 140 may match the materials used to manufacture shaft 120. Landing guard 140 may also be manufactured from AISI 4140 steel. Landing guard 140 may also be a non-ferromagnetic material. Landing guard 140 manufactured from ferromagnetic materials may interfere with the operation of radial magnetic bearing 125. Landing guard 140 may be manufactured as a single piece.

INDUSTRIAL APPLICABILITY

Centrifugal gas compressors are used to move process gas from one location to another. Centrifugal gas compressors are often used in the oil and gas industries to move natural gas in a processing plant or in a pipeline. Centrifugal gas compressors are driven by gas turbine engines, electric motors, or any other power source.

There is a desire to achieve greater efficiencies and reduce emissions in large industrial machines such as centrifugal gas compressors. Installing magnetic bearings in a centrifugal gas compressor may accomplish both desires. Centrifugal gas compressors may achieve greater efficiencies with magnetic bearings by eliminating any contact between the bearings and rotary element. Contact between the bearings and the rotary element generally causes frictional losses to occur. Magnetic bearings may use electromagnetic forces to levitate and support the rotary element without physically contacting the rotary element eliminating the frictional losses.

Using magnetic bearings may reduce or eliminate production of undesirable emissions. These emissions may be produced by leaking or burning a lubricant such as oil. Eliminating the contact and frictional losses between the rotary element and bearings by supporting the rotary element with magnetic bearings may eliminate or reduce the need for lubricants in centrifugal gas compressors. With this elimination or reduction of lubricants or oil, the emissions in centrifugal gas compressors may be reduced or eliminated. Eliminating lubricants may also eliminate the need for the valves, pumps, filters, and coolers associated with lubrication systems.

In centrifugal gas compressor 100 radial magnetic bearing 125 supports shaft 120 radially using magnetic levitation. Radial magnetic bearing 125 uses windings 126. Windings 126 are electromagnets that produce a magnetic field. The magnetic field is generated by the electrical currents traversing windings 126. The attractive force of each winding 126 may be controlled by varying the electric current traversing the winding 126. The magnetic field produced by windings 126 interacts with the ferromagnetic material of lamination 127. The magnetic forces act on shaft 120 through lamination 127 to levitate shaft 120 without any contact between windings 126 and lamination 127.

Designing magnetic bearings to replace mechanical bearings in centrifugal gas compressors does not come without its challenges. Magnetic bearings may lose power or fail. Without support from the magnetic bearings shaft 120 may be damaged when shaft 120 falls and contacts elements of the magnetic bearings or elements of the centrifugal gas compressor.

Auxiliary bearings 135, such as angular contact bearings, are installed in centrifugal gas compressor 100. Auxiliary bearings 135 prevent shaft 120 from contacting radial magnetic bearing 125 or other parts of centrifugal gas compressor 100 when radial magnetic bearing 125 fails or loses power. However, auxiliary bearings 135 may damage shaft 120 if shaft 120 drops from radial magnetic bearing 125 onto auxiliary bearings 135 or if shaft 120 rubs auxiliary bearings 135.

It was determined through research and development that landing guard 140 may be coupled to shaft 120 between shaft 120 and auxiliary bearings 135. When radial magnetic bearing 125 loses power or shuts off, landing surface 142 may act as a landing area and may contact auxiliary bearings 135. Auxiliary bearings 135 may support shaft 120 through contact with landing guard 140 until radial magnetic bearing 125 is reactivated.

Landing guard 140 serves as a sacrificial piece to protect shaft 120 from impact damage, friction damage, or scoring. Any damage will occur to landing guard 140 at landing surface 142 rather than to shaft 120. The nitride coating may provide the hardness needed at landing surface 142 for landing surface 142 to serve as a landing area for auxiliary bearings 135.

Damage to shaft 120 may further be avoided by preventing rotational displacement or slipping between shaft 120 and landing guard 140. This may be accomplished by coupling landing guard 140 to shaft 120 with an interference fit. Landing guard 140 may be heated to expand the dimensions of landing guard 140. The thermally expanded landing guard 140 may then be installed onto shaft 120 and cooled to create the interference fit.

Pins 121 help prevent landing guard 140 from rotating relative to shaft 120. Each pin 121 may be installed into a hole in shaft 120. Each pin 121 protrudes from shaft 120 into a corresponding slot 144 of landing guard 140 when landing guard 140 is installed onto shaft 120. The contacts between landing guard 140, shaft 120, and the one or more pins 121 may prevent landing guard 140 from rotating relative to shaft 120.

As a sacrificial piece, landing guard 140 may need to be replaced during maintenance of centrifugal gas compressor 100. Re-heating landing guard 140 may not be a viable method for removing landing guard 140 from shaft 120. Re-heating landing guard 140 may cause thermal damage to shaft 120. Threads 146 may be used to couple a removal tool to landing guard 140 to aid in removal of landing guard 140 from shaft 120. Coupling a removal tool to flange 145 may provide leverage for removing landing guard 140 from shaft 120.

Shelf 124 may be used for aligning lamination sleeve 130 axially with shaft 120 and may help align lamination 127 with windings 126. Maintaining proper alignment of lamination 127 with windings 126 within centrifugal gas compressor 100 may help ensure efficient operation of radial magnetic bearing 125. Shelf 124 is located on shaft 120 to signify the installation position of the forward end of lamination sleeve 130 which is aligned with shelf 124 when installed onto shaft 120.

Shaft 120 may be tapered to prevent lamination sleeve 130 from sliding axially aft along shaft 120. This axial constraint may help maintain alignment between lamination 127 and windings 126 during operation of centrifugal gas compressor 100.

Landing guard 140 may be installed onto shaft 120 with an interference fit to prevent landing guard 140 from slipping in the axial direction. The aft end of landing guard 140 abuts shelf 124 and lamination sleeve 130 to aid in maintaining alignment between shaft 120 and lamination sleeve 130. Landing guard 140 may thus assist in preventing lamination sleeve 130 from sliding axially forward along shaft 120 and maintaining proper alignment of lamination 127 with windings 126.

Flange 145 may be located at the aft end of landing guard 140 to provide a larger surface at the aft end of landing guard 140. A larger surface may be needed to maintain alignment of shelf 124 with the forward end of lamination sleeve 130. An increased contact area between landing guard 140 and lamination sleeve 130 may be necessary to prevent misalignment of lamination 127 with windings 126.

The preceding detailed description is merely exemplary in nature and is not intended to limit the invention or the application and uses of the invention. The described embodiments are not limited to use in conjunction with a particular type of gas compressor. Hence, although the present embodiments are, for convenience of explanation, depicted and described as being implemented in a centrifugal gas compressor, it will be appreciated that it can be implemented in various other types of compressors, and in various other systems and environments. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

What is claimed is:

1. An auxiliary bearing landing guard for a shaft of a centrifugal gas compressor with a radial magnetic bearing, comprising:

a landing portion with an axially elongated tubular shape and an exterior landing surface configured to contact the auxiliary bearing when the radial magnetic bearing fails;

an inner surface located radially inward from the landing surface, the inner surface configured to contact the shaft when the landing guard is installed on the shaft; and an annular flange extending from an aft end of the landing portion having an outer diameter located radially outward from an outer diameter of the landing portion, wherein the flange includes threads.

2. The landing guard of claim 1, further comprising a slot located on the inner surface extending axially from an aft end of the landing guard toward a forward end of the landing guard, the slot configured to receive a pin to prevent angular displacement between the shaft and the landing guard when the landing guard is installed on the shaft.

3. The landing guard of claim 2, wherein the slot extends from the forward end of the landing guard to the aft end of the landing guard.

4. The landing guard of claim 3, wherein the slot has a square cross-section.

5. An auxiliary bearing landing guard for a shaft of a centrifugal gas compressor with a radial magnetic bearing, comprising:

a landing portion with an axially elongated tubular shape and an exterior landing surface configured to contact the auxiliary bearing when the radial magnetic bearing fails;

an inner surface located radially inward from the landing surface, the inner surface configured to contact the shaft when the landing guard is installed on the shaft; and an annular flange extending from an aft end of the landing portion having an outer diameter located radially outward from an outer diameter of the landing portion, wherein the landing guard comprises a non-ferromagnetic material.

6. The landing guard of claim 5, further comprising a slot located on the inner surface extending axially from an aft end of the landing guard toward a forward end of the landing guard, the slot configured to receive a pin to prevent angular displacement between the shaft and the landing guard when the landing guard is installed on the shaft.

7. The landing guard of claim 6, wherein the slot extends from the forward end of the landing guard to the aft end of the landing guard.

8. The landing guard of claim 6, wherein the slot has a square cross-section.

9. The landing guard of claim 5, wherein a nitride coating is applied to the landing surface.

10. The landing guard of claim 5, wherein the landing guard is manufactured as a single piece.

11. A centrifugal gas compressor, comprising:

a shaft having a pin;

a radial magnetic bearing having a plurality of windings, and a lamination sleeve, wherein the lamination sleeve is installed to the shaft with an interference fit;

an auxiliary bearing; and a landing guard installed to the shaft with an interference fit adjacent the lamination sleeve, the landing guard having a landing portion with an axially elongated tubular shape, and an exterior landing surface configured to contact the auxiliary bearings when the radial magnetic bearing fails, an inner surface located radially inward from the landing surface, the inner surface configured to contact the shaft, a slot located on the inner surface extending axially from an aft end of the landing guard toward a forward end of the landing guard, the slot configured to receive the pin to prevent angular displacement between the shaft and the landing guard, and a flange extending from an aft end of the landing portion having an outer diameter located radially outward from an outer diameter of the landing portion.

12. The centrifugal gas compressor of claim 11, wherein the flange includes threads.

13. The centrifugal gas compressor of claim 11, wherein the shaft has multiple pins and the landing guard includes multiple slots located on the inner surface extending axially from an aft end of the landing guard toward a forward end of the landing guard, each slot configured to receive a respective pin to prevent angular displacement between the shaft and the landing guard.

14. The centrifugal gas compressor of claim 12, wherein the shaft has multiple pins and the landing guard includes multiple slots located on the inner surface extending axially from an aft end of the landing guard toward a forward end of the landing guard, each slot configured to receive a respective pin to prevent angular displacement between the shaft and the landing guard.

15. The centrifugal gas compressor of claim 11, wherein the slot extends from the forward end of the landing guard to the aft end of the landing guard.

16. The centrifugal gas compressor of claim 14, wherein each slot extends from the forward end of the landing guard to the aft end of the landing guard.

17. The centrifugal gas compressor of claim 11, wherein the slot has a square cross-section.

18. The centrifugal gas compressor of claim 16, wherein each slot has a square cross-section.

19. The centrifugal gas compressor of claim 11, wherein the auxiliary bearing comprises an angular contact bearing.

* * * * *